United States Patent [19]

Martini et al.

[11] 3,933,426

[45] Jan. 20, 1976

[54] PROCESS FOR MAKING TEXTILES CONTAINING CELLULOSE CREASE-RESISTANT

[75] Inventors: Bruno Martini, Rheinfelden, Switzerland; Gunter Pusch, Leitershofen, Germany; Erich Rossler, Leitershofen, Germany; Dieter Walz, Hainhofen, Germany

[73] Assignee: Ciba-Geigy Corporation, Ardsley, N.Y.

[22] Filed: Oct. 2, 1973

[21] Appl. No.: 402,663

[30] Foreign Application Priority Data

Oct. 7, 1972 Germany ..... 2249272

[52] U.S. Cl. ..... 8/183; 8/184; 8/185; 8/186

[51] Int. Cl.[2] ..... D06M 13/34

[58] Field of Search ..... 8/184, 185, 186, 196, 182, 8/183

[56] References Cited

UNITED STATES PATENTS

| | | | |
|---|---|---|---|
| 3,041,199 | 6/1962 | Miller | 8/184 |
| 3,082,118 | 3/1963 | Shaw | 8/184 |
| 3,090,665 | 5/1963 | Parsons | 8/184 |
| 3,565,824 | 2/1971 | Pierce | 8/185 |
| 3,650,671 | 3/1972 | Bergmann | 8/184 |
| 3,676,053 | 7/1972 | Miyake | 8/184 |
| 3,827,858 | 8/1974 | Byrne | 8/184 |

FOREIGN PATENTS OR APPLICATIONS

| | | |
|---|---|---|
| 1,120,965 | 7/1968 | United Kingdom |

*Primary Examiner*—Benjamin R. Padgett
*Assistant Examiner*—Donald P. Walsh
*Attorney, Agent, or Firm*—Edward McC. Roberts; Joseph G. Kolodny; Prabodh I. Almaula

[57] ABSTRACT

This invention relates to a process for making textiles containing cellulose crease-resistant.

The process of the invention involves contacting the textile with an aqueous treatment bath to which alkali chlorides or bromides of sodium and potassium have been added and which contains 1,3-dimethylol-4,5-dihydroxyethylene urea, the hydroxyl and methylol groups of which can optionally be partially or completely etherified with low, monohydric aliphatic alcohols with 1 to 3 carbon atoms and potential acid catalysts. It is possible for the treatment bath to contain in addition other precondensates normally used in the treatment of textiles provided at least 40% by weight based on the weight of the sum of the N-methylol derivatives calculated as anhydrous substances is the optionally etherified 1,3-dimethylol-4,5-dihydroxyethylene urea. 1 to 12% by weight of the alkali metal chloride or a bromide of sodium and potassium based on the weight of the N-methylol derivatives calculated as anhydrous substances are employed in the treatment bath. After contacting the textile with the bath it is dried and heated to cure the resin and/or crosslink it with the fibre.

12 Claims, No Drawings

PROCESS FOR MAKING TEXTILES CONTAINING CELLULOSE CREASE-RESISTANT

This invention relates to a process for making a textile containing cellulose crease-resistant.

Textiles which contain cellulose can be given a creaseresistant finish with resin precondensates. Suitable resin precondensates are those which react with one another under the action of heat and with addition of catalysts to form waterinsoluble resins or react by crosslinking with the cellulose. Many different types of N-methylol derivatives of nitrogenous compounds are used for this purpose, it also being possible for the methylol groups to be present in etherified form. Examples of the starting substances forming the basis of the methylol compounds are urea and urea derivatives, such as cyclic ethylene urea and propylene urea, which can also contain substituents, such as hydroxyl groups, in the alkylene group, urones and possibly substituted triazone resins, as well as melamine. In addition, nitrogen-free resins, such as acetal resins, have also acquired a certain importance.

The process generally employed for the crease-resistant finishing of textiles comprises impregnating the textile material with aqueous solutions of such resin precondensates, which contain a catalyst capable of behaving as an acid, whereafter it is squeezed out to the required solution absorption, dried and thereafter heated to a relatively high temperature for the curing or crosslinking with the fibre, it being mainly in the heating stage that the concurrently employed catalyst develops its effect.

A modification of this process as described consists in having a relatively long time period between the drying and curing, in which period the pretreated material is subjected to certain technical processes such as for example, ready-making into the finished garment. This process is usually referred to as one "with deferred curing."

The above-mentioned N-methylol compounds are not equivalent to one another. Some of them produce an unfavourable ratio of crease recovery to tensile strength or else the creaseresistant properties are not sufficiently wash-resistant, while others are sensitive to chlorine-containing detergents, and yet others impair the degree of whiteness of the textiles treated therewith and have an unfavourable influence on the lightfastness of dyed textiles. This means, in other words, it is necessary always to select those resin precondensates or mixtures of resin precondensates which are most suitable for the specifically required purpose. Added to this is the problem of choosing the correct catalyst.

Among the catalysts, and as already briefly mentioned, there are generally used so-called potential acid catalysts, i.e. those catalysts which only develop their acidic effect under heat. Examples include magnesium chloride, zinc chloride, zinc nitrate and ammonium salts and salts of amines.

It has been proposed to add to such catalysts inert inorganic salts such as sodium chloride, lithium chloride, calcium chloride and sodium-dihydrogen phosphate when effecting the finish with the above-mentioned N-methylol compounds, since in this way a higher moisture-restraining power of the finished fabric is produced. Apart from the fact that calcium chloride and also sodium-dihydrogen phosphate cannot themselves be referred to as being "inert," since they do indeed act as weak catalysts, these inert salts have to be used in disproportionately large quantities in order to fulfill the required purpose. This means of course that these salts have to be washed out again after the finishing, which necessitates an additional working step and makes it impossible in practice to use this procedure with the deferred curing process.

1,3-Dimethylol-4,5-dihydroxyethylene urea has recently acquired particular significance in respect of the processes initially referred to. However, with this resin precondensate, of which the N-methylol and hydroxyl groups can also be partially or completely etherified with low alcohols, the problem arises that with white materials, the degree of whiteness suffers considerably, and with coloured materials changes in the colour tone are observed during the heat treatment.

It has now surprisingly been found that these disadvantages are avoided if alkali metal chlorides such as sodium, potassium or lithium chlorides or bromides of sodium and potassium more especially NaCl and KCl, are added to the treatment baths which contain 1,3-dimethylol-4,5-dihydroxyethylene urea, the hydroxyl and methylol groups of which can optionally be partially or completely etherified with low, monohydric, aliphatic alcohols with 1 to 3 carbon atoms, and potentially acid catalysts. Besides the dimethyloldihydroxyethylene urea, it is also possible to use at the same time other precondensates used in the treatment of textiles.

Thus according to the present invention there is provided a process for making textile material containing cellulose creaseresistant, comprising contacting the textile material with an aqueous finishing solution containing one or more N-methylol derivatives of nitrogenous compounds of which the methylol groups may optionally be etherified and of which at least 40% by weight based on the weight of the sum of the N-methylol derivatives calculated as anhydrous substances is 1,3-dimethylol-4,5-dihydroxyethylene urea, the hydroxyl and methylol groups of which may optionally be partially or completely etherified with a monohydric alphatic alcohol containing 1 to 3 carbon atoms, a potential acid catalyst, and from 1 to 12% by weight based on the weight of the N-methylol derivatives calculated as anhydrous substances of an alkali metal chloride or a bromide of sodium and potassium and drying and heating the textile material to cure the resin and/or cross-link it with the fibre.

The process according to the invention is used for making textile material containing cellulose creaseresistant by application of aqueous finishing solutions which contain N-methylol derivatives of nitrogenous compounds, the methylol groups being optionally present in their etherified form, potentially acid catalysts, inert inorganic metal salts and optionally acetal resins, drying and heating to relatively high temperatues, it being possible for another processing of the textile material, more particularly ready-made to the finished garment, to be interposed between the drying and heating.

N-methylol derivatives of other nitrogenous compounds can be used in the process provided at least 40% by weight of the N-methylol derivatives is 1,3-dimethylol-4,5-dihydroxyethylene urea calculated as anhydrous substances.

The textile material treated by the process according to the invention suprisingly shows practically no yellowing and, with coloured material, there is practically no change in colour tone. In addition, textiles as thus finished usually show an advantageous behaviour when being washed with detergents which contain chlorine. In addition, by adding the neutral salts, the crease-resistant properties and the wash-and-wear behaviour are not in practice affected.

The alkali metal salts are used in amounts from 1 to 12 and more particularly 2 to 8% by weight, based on the weight of the N-methylol derivatives, calculated as anhydrous substances. Sodium chloride and potassium chloride have proved to be particularly suitable as inert inorganic salt.

The possibility of the inert, inorganic metal salts being added at the outset to the concentrated solution of the dimethylol dihydroxytethylene urea which is marketed as a commercial product and which, as will hereinafter be more fully explained may also contain other resin precondensates, thus simplyfying the process is possible.

As already mentioned, the 1,3-dimethylol-4,5-dihydroxyethylene urea can also be present in a form in which it is partially or completely etherified with monohydric alcohols with 1 to 3 carbon atoms. Such products have previously been used in the treatment of textiles. Furthermore, the commercial products or the treatment solutions produced therefrom can also contain monohydric alcohols with 1 to 3 carbon atoms, whether these are produced in the preparation or whether they are purposely added to effect a more rapid and thorough wetting of the textile material to be treated during the process.

To be considered as potential acid catalysts are the usual catalysts used for curing 1,3-dimethylol-4,5 dihydroxyethylene urea in the treatment of textiles, such as potentially acid metal salts and ammonium salts and salts of amines, zinc nitrate being most suitable and magnesium chloride and zinc chloride being the next most suitable.

As already mentioned, it is possible for some of the dimethyloldihydroxyethylene urea to be replaced by some of the other resin precondensates which are normally used in the treatment of textiles and which can be cured under acid conditions and heat or cross-linked with the textile material. Nevertheless, the proportion of the dimethylol dihydroxyethylene urea should amount to at least 40% by weight and more especially at least 60% by weight, based on the sum of dimethyloldihydroxyethylene urea and other resin precondensates.

Examples of additional resin precondensates are the N-methylol compounds of urea which are optionally etherified with low monohydric alcohols, ethylene urea, propylene urea, 5-hydroxypropylene urea, the alkyl and hydroxyalkyl carbamates and tetrahydrotriazinone. Water-soluble methylol compounds of malamine with at least 4 methylol groups, in which the methylol groups are partially or completely etherified with low, monohydric aliphatic alcohols with 1 to 3 carbon atoms, have proved to be particularly suitable. This is because with these compounds the advantages of good whiteness and very small shifts in colour tone and the favourable resistance to chlorine and operational safety as regards breadth of condensationn are particularly apparent. In addition a more favourable ratio between effect and strength is to be observed, the individual effects not only being additive, but having a mutually favourable influence.

Furthermore, nitrogen-free resins, such as acetal resins and semiacetals, i.e. products which can be obtained by reacting formaldehyde with monohydric or polyhydric alcohols, are also suitable.

It is obviously also possible for the treatment baths for use in the invention to have added thereto conventional finishing agents, such as handle-improving additives, waterrepellent and oil-repellent agents, flameproofing agents, optical brighteners and the like.

Among the cellulose-containing textile materials are included woven and knitted fabrics and fleeces which contain at least 15% by weight of cotton, regenerated cellulose or linen or consist of the same. The textile material in sheet form can thus contain up to 85% by weight of fibres of a different nature, more particularly synthetic fibres.

The treatment of the textile material is carried out in the usual way by the dry condensation process, in which the treatment solution is applied to the textile material, for example, by immersion. Thereafter, the material is squeezed out to the required solution absorption, dried and heated to a relatively high temperature to cure the resin or cross-link it with the textile. Suitable temperatures are 140° to 190°C and the heating should usually be effected for about 10 seconds to 10 minutes in order to cure the dimethyloldihydroxyethylene urea or its mixtures with the other precondensates. As already mentioned, the process of the invention is also suitable for the delayed hardening process. This differs from the dry condensation process in that a premature curing of the dimethyloldihydroxyethylene urea is avoided by careful drying and the curing only taking place after additional processing steps, more especially after the ready-making operation, by heating by means of hot air, steam or contact heat to higher temperature. There may be a period of several months between drying and curing.

The application of the solution can obviously be effected in other ways, for example, by spraying, slop-padding or application under pressure.

The following test methods are used in the examples for evaluating the technical effects: Dry crease angle (average of warp and weft) according to DIN 53890, Wet crease angle according to GUTV (Gutezeichenverband Textilveredlung e.V.), wash and wear behaviour: classification after 5 machine washings at 90°C; evaluation of the dried specimens by the "Monsanto Standard". Judgement of the degree of whiteness by the GEIGY whiteness scale from 50 to 260, 50 characterising a very poor, yellowish white and 260 a maximum whiteness which can be achieved with optical brighteners (A. Rauchle et al. TEXTILVEREDLUNG 2, No. 9 pages 719 to 729).

The invention will now be illustrated with reference to the following Examples. All percentages mentioned therein are by weight unless otherwise indicated.

EXAMPLE 1

A mercerised, bleached and optically pre-brightened pure cotton poplin with a weight per square meter of 126 g was treated with a bath solution by impregnation and squeezing out to 70% solution absorption, the bath solution containing, per liter, 150 g of the following resin, 22 g of magnesium chloride hexahydrate and 0.5 cc of 60% acetic acid. The resin used was a 44% aqueous solution of 1,3-dimethylol-4,5-dihydroxyethylene urea, in which were dissolved 3% by weight of common salt, based on the weight of resin, calculated as anhydrous substance. The fabric as thus treated was thereafter dried at 110°C and condensed for 3 minutes at 180°C. (Finish A).

For comparison purposes, pieces of the same cotton poplin were finished in the same manner, but without adding common salt (Finish B).

The superiority of the process according to the invention was readily apparent from the following figures: in the case of the resin to which common salt was added, both a good degree of whiteness and also optimal crease effects and wash-and-wear effects were obtained.

| | Crease angle; average of warp and weft dry | wet | Wash-and-wear effect (Monsanto note) | Whiteness scale |
|---|---|---|---|---|
| A) according to the invention | 142 | 138 | 4.6 | 220 |
| B) prior art | 141 | 140 | 4.5 | 190 |

| | Crease angle; average of warp and weft dry | wet | Wash-and-wear effect (Monsanto note) | Change in colour tone |
|---|---|---|---|---|
| A) according to the invention | 142 | 144 | 4.6 | very slight |
| B) prior art | 146 | 145 | 4.7 | very strong |

EXAMPLE 3

A bleached polyester/cotton poplin (50:50) with a weight per square meter of 102 g was padded with a solution and with a squeezing or wringing effect of 62%, the solution containing, per liter, 200 g of the following resin, 30 g of a 20% non-ionic polyethylene emulsion, 15 g of zinc chloride, 6g/l of an optical brightener of the formula:

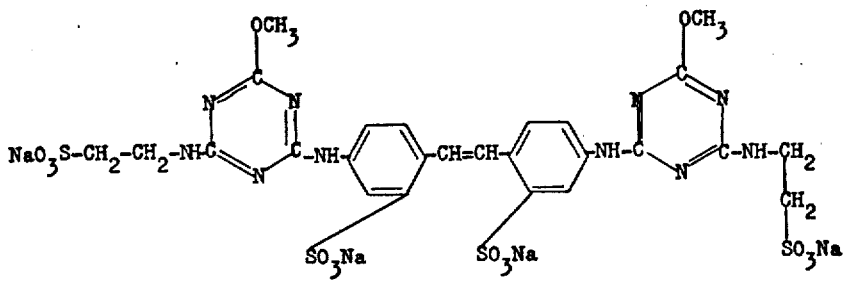

EXAMPLE 2

A 100% cotton batiste (weight per square meter 98 g), dyed with ANTHRASOLBLAU IBC (C.I. 69826) was impregnated with a bath solution and squeezed out to 68% solution absorption, the bath solution containing, per liter, 80 g of 1,3-dimethylol-4,5-dihydroxyethylene urea (100%), 4g of potassium chloride, 2 cc of 60% acetic acid and 12g of zinc nitrate hexahydrate. Drying was then carried out at 120°C and condensation for 5 minutes at 165°C (Finish A).

For comparison purposes, a piece of the same dyed batiste was finished in exactly the same way, with the sole difference that the bath solution did not contain any neutral salt (Finish B). The results set out in the following table were obtained:

| | Tensile strength according to Schopper weft | Crease angle; average warp and weft dry | wet | Wash-and-wear effect | Whiteness scale |
|---|---|---|---|---|---|
| A) according to the invention | 31 kg | 147 | 144 | 4.7 | 240 |
| B) prior art | 29 kg | 148 | 142 | 4.7 | 220 |

EXAMPLE 4

The poplin described in Example 3 was finished acin normal commercial form (content of active substance practically 100%) and 1cc of 60% acetic acid. The resin was an aqueous solution which contains 32% of 1,3-dimethylol-4,5-dihydroxyethylene urea, 10% of trimethylether of pentamethylol melamine and 2% of common salt (related to the anhydrous resin precondensates). The woven fabric was thereafter dried and condensed for 2½ minutes at 170°C (Finish A).

For comparison purposes, a finish was produced on the same woven fabric under the same conditions, with the sole difference that the treatment solution did not contain common salt (Finish B).

The results obtained are set out in the following table:

cording to Example 3, in one case with addition of common salt (Finish A), and in another case without common salt (Finish B), the sole difference being that 15 g/l of zinc nitrate hexahydrate were used instead of 15 g/l of zinc chloride. In this case an even greater improvement as regards the degree of whiteness was shown by the addition of neutral salt.

| Whiteness scale | |
|---|---|
| Finish A | 230 |
| Finish B | 190 |

EXAMPLE 5

A dyed Helanca/staple rayon fabric (70:30) was treated by dipping and squeezing out to 75% solution absorption, using a bath solution containing, per liter, 180 g of a 44% aqueous solution of 1,3-dimethylol-4,5-dihydroxyethylene urea, 9 g of lithium chloride, 4 g of 2-methyl-2-aminopropanol hydrochloride, 3 g of polyvinyl alcohol with a molecular weight of 1700 and a degree of saponification of 99%, and also 20 g of a 25% non-ionic, finely divided emulsion of stearic acid amide. The padded fabric was thereafter dried at 110°C and it was only after being stored for 4 weeks and being ready-made in the form of pressed trousers that it was condensed for 8 minutes at 160°C.

The trousers as thus finished showed excellent wash-and-wear properties and the ironed crease had a good permanence on being washed. The change in colour tone on heating was negligible and the loss of abrasion resistance was small.

EXAMPLE 6

Example 5 was repeated, with the difference that sodium bromide was used as neutral salt. The same good results were also obtained when sodium bromide was used.

EXAMPLE 7

A white, bleached, optically pre-brightened staple rayon/polyester muslin (67:33), with a weight per square meter of 152 g, was kissed with a bath solution (application 35%), which contained, per liter, 50 g of 1,3-dimethylol-4,5-dihydroxyethylene urea, 20 g of ethylene glycol disemiformal, 30 g of dimethylol urea, 2 g of sodium chloride, and 20 g of zinc chloride. The material was thereafter dried and condensed for 2 minutes at 165°C. The finish showed a high spring elasticity and a good degree of whiteness.

What we claim is:

1. A process for making textile containing cellulose crease-resistant which comprises contacting the textile material with an aqueous finishing solution containing one or more N-methylol or N-methylol ether derivatives of nitrogenous compounds and of which at least 40% by weight based on the weight of the sum of the N-methylol derivatives calculated as anhydrous substances is 1,3-dimethylol-4,5-dihydroxyethylene urea the hydroxyl and methylol groups of which are free or are partially or completely etherified with a monohydric aliphatic alcohol containing 1 to 3 carbon atoms, a potential acid catalyst, and from 1 to 12% by weight based on the weight of the N-methylol derivatives calculated as anhydrous substances of an alkali metal chloride or a bromide of sodium or potassium and drying and subjecting the textile material to a heat treatment.

2. A process according to claim 1 which comprises using the alkali metal chlorides or the bromides of sodium and potassium in a quantity of from 2 to 8% by weight, based on the weight of the N-methylol derivatives calculated as anhydrous substances.

3. A process according to claim 1 which comprises initially adding the inert inorganic salts to the aqueous solution of the N-methylol derivatives of nitrogenous compounds containing 1,3-dimethylol-4,5-dihydroxyethylene urea.

4. A process according to claim 1 which comprises using at least 60% by weight of the N-methylol derivatives of nitrogenous compounds based on the weight of the sum of the N-methylol derivatives calculated as anhydrous substances is 1,3-dimethylol-4,5-dihydroxyethylene urea.

5. A process according to claim 1 which comprises using a finishing solution containing, in addition to the 1,3-dimethylol-4,5-dihydroxyethylene urea the hydroxyl and methylol groups of which are free or partially or completely etherified with a monohydric aliphatic alcohol containing 1 to 3 carbon atoms, methylol melamines with a least 4 methylol groups, the methylol groups being partially or completely etherified with monohydric, aliphatic alcohols with 1 to 3 carbon atoms, in an amount of from 1 to 40% based on the weight of the 1,3-dimethylol-4,5-dihydroxyethylene urea and methylol melamine, calculated as anhydrous substances.

6. A process according to claim 1 which comprises using as the inert inorganic salt sodium chloride or potassium chloride.

7. A process according to claim 1 which comprises using N-methylol derivatives of nitrogenous compounds additionally including one or more acetal resins.

8. A process according to claim 1 which comprises between the drying and heating subjecting the textile material to other processes.

9. A process according to claim 8 which comprises as the other processes ready-making of the finished garment.

10. A process according to claim 1 which comprises subjecting the treated textile material to a heat treatment at 140° to 190°C.

11. The cellulosic textile material treated according to the process of claim 1.

12. A process according to claim 5 which comprises subjecting the treated textile material to a heat treatment at 140° to 190°C.

* * * * *